United States Patent [19]

Hanson

[11] Patent Number: 4,977,751

[45] Date of Patent: Dec. 18, 1990

[54] REFRIGERATION SYSTEM HAVING A MODULATION VALVE WHICH ALSO PERFORMS FUNCTION OF COMPRESSOR THROTTLING VALVE

[75] Inventor: Jay L. Hanson, Bloomington, Minn.

[73] Assignee: Thermo King Corporation, Minneapolis, Minn.

[21] Appl. No.: 458,206

[22] Filed: Dec. 28, 1989

[51] Int. Cl.[5] ..... G05D 23/32

[52] U.S. Cl. ..... 62/81; 62/158; 62/217

[58] Field of Search ..... 62/217, 81, 158 X

[56] References Cited

U.S. PATENT DOCUMENTS

| | | | |
|---|---|---|---|
| 3,973,618 | 8/1976 | Naley et al. | 165/27 |
| 4,325,224 | 4/1982 | Howland | 62/196 A |
| 4,419,866 | 12/1983 | Howland | 62/228.4 |
| 4,689,967 | 9/1987 | Han et al. | 62/217 |
| 4,712,383 | 12/1987 | Howland et al. | 62/200 |
| 4,742,689 | 5/1988 | Lowes | 62/197 |
| 4,819,441 | 4/1989 | Hanson | 62/160 |

*Primary Examiner*—William E. Wayner
*Attorney, Agent, or Firm*—D. R. Lackey

[57] ABSTRACT

A refrigeration system having a modulation valve which controls refrigerant flow to a compressor according to a control algorithm. The need for a compressor throttling valve is eliminated by a load control circuit which operates the modulation valve to perform the function of the throttling valve when load reduction is required. An overload condition of a compressor prime mover overrides the control algorithm and selects a predetermined load control position of the modulation valve. A timer ensures that a predetermined recovery time is provided, before switching back to the control algorithm. The timer also selects the load control position of the modulation valve upon start-up. A heating or defrost mode automatically selects the load control position of the modulation valve for the duration of the mode, as does an ambient air temperature sensor when the ambient exceeds a predetermined value.

13 Claims, 3 Drawing Sheets

FIG. 1
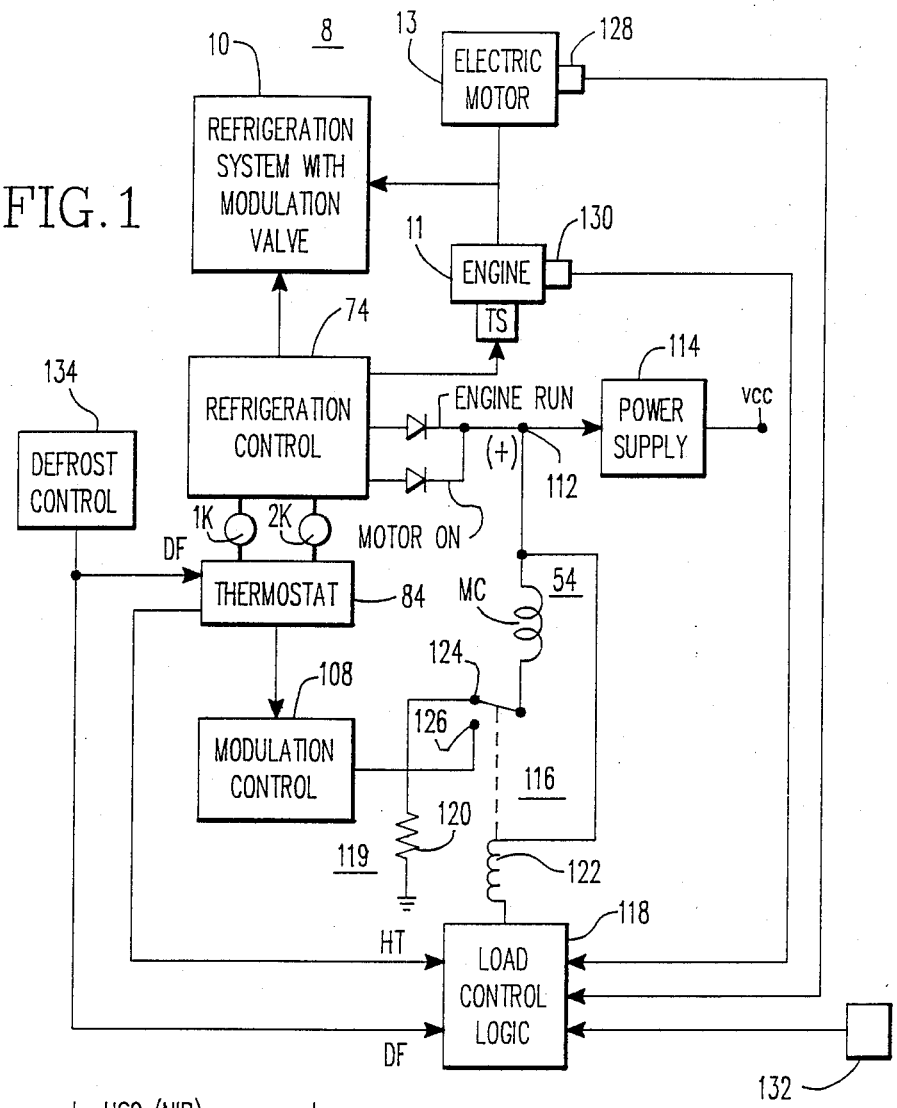
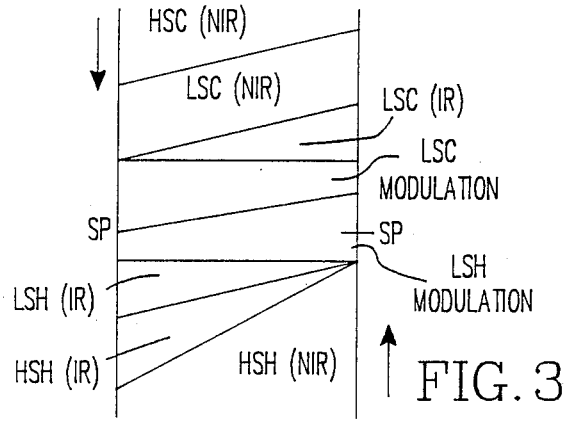
FIG. 3

REFRIGERATION SYSTEM HAVING A MODULATION VALVE WHICH ALSO PERFORMS FUNCTION OF COMPRESSOR THROTTLING VALVE

TECHNICAL FIELD

The invention relates to refrigeration systems, and more specifically to refrigeration systems which utilize a controllable suction line modulation valve.

BACKGROUND ART

Refrigeration systems commonly employ a compressor throttling valve set to a fixed pressure setting to limit the load on the compressor prime mover. The throttle valve is set to limit the pressure and the load on the prime mover for the worst case condition, which is during a hot gas defrost mode. The defrost setting penalizes the cooling capacity of the refrigeration system, as the restriction in the suction line presented by the throttle valve is present at all times.

When the compressor will be driven by a selected one of two prime movers, such as in a transport refrigeration system which may be driven by an electric motor when an associated truck, trailer, or container is stationary and near a source of electric potential, and otherwise by a Diesel engine, the worst case condition takes into account the smaller of the two power ratings. Thus, the pressure setting of the throttling valve is set for the horsepower of the electric motor and the normally greater power available from the Diesel engine is not usable.

Co-pending application Ser. No. 304,686, filed Feb. 1, 1989, entitled "Transport Refrigeration System With Improved Temperature And Humidity Control", now U.S. Pat No. 4,899,549 which is assigned to the same assignee as the present application, discloses a suction line modulation valve and associated modulation control. The modulation control controls the modulation valve to restrict the suction line during heating and cooling modes near the set point temperature, according to a predetermined control algorithm, with the valve otherwise being open. The normal compressor throttling valve is eliminated, with a prime mover overload condition causing the modulation control to control the modulation valve to restrict the suction line and reduce the pressure, thus reducing the load on the prime mover.

SUMMARY OF THE INVENTION

Briefly, the present invention is an improvement upon the feature of the co-pending application related to the use of a suction line modulation valve to perform the function of a compressor throttling valve. In the present invention a control relay has a de-energized, and thus fail-safe position, which selects a circuit independent of the modulation control for controlling the current through the coil of the modulation valve to close the modulation valve to a predetermined position. The predetermined position is selected for the type of refrigerant used and the horsepower available to drive the compressor under the worst case condition. As hereinbefore stated, the worst case condition would be for the defrost mode, when hot refrigerant vapor is used to defrost the evaporator coil, with the horsepower being the horsepower of the electric motor, when both a motor and an engine are selectively used to drive the compressor.

The control relay has an energized position which selects the normal modulation control. When there is no reason to restrict the suction line, a logic circuit energizes the control relay and allows a control algorithm to control current flow through the coil of the modulation valve. When a condition occurs which may overload the compressor prime mover, the logic circuit de-energizes the control relay, overriding the control algorithm, and controlling the current through the coil of the modulation valve to provide the predetermined restriction in the suction line.

A timer maintains the control relay in the de-energized state for a predetermined period of time upon initial start-up of the refrigeration system, to provide a warm-up period before increasing the load and cooling capacity. A predetermined overload condition of the operative prime mover causes the logic circuit to de-energize the control relay and select the predetermined restricted position of the modulation valve. The timer then prevents return to the energized position of the control relay for the predetermined period of time, to allow a recovery time for the overloaded prime mover, as well as to prevent short cycling of the control relay which may occur when the predetermined overload condition varies about the threshold which causes the overload signal to be generated.

The logic circuit is also responsive to the initiation of hot gas heating and defrost cycles or modes, de-energizing the control relay for the duration of each of such modes. The outside ambient air temperature is also monitored. If the outside ambient air temperature exceeds a predetermined value, the control relay is also de-energized for the duration of such a condition plus the time delay provided by the timer. The predetermined value depends upon the operating characteristics of the specific refrigeration unit design being used. Tests upon one particular design found that the unit would operate in the cool mode without exceeding load limits, with no throttling valve, until the ambient temperature exceeded about 105 degrees F. (40 degrees C.).

BRIEF DESCRIPTION OF THE DRAWINGS

The invention will become more apparent by reading the following detailed description in conjunction with the drawings, which are shown by way of example only, wherein:

FIG. 1 is a partially block and partially schematic diagram of a refrigeration system constructed according to the teachings of the invention;

FIG. 3 is a diagram setting forth an exemplary control algorithm which may be used to control a suction line modulation valve used in the refrigeration system of the present invention.

DESCRIPTION OF PREFERRED EMBODIMENTS

Certain of the refrigeration control utilized may be conventional, and in shown in U.S. Pat. Nos. 4,325,224; 4,419,866; and 4,712,383, for example. These patents are hereby incorporated into the specification of the present application by reference.

Figure 2:
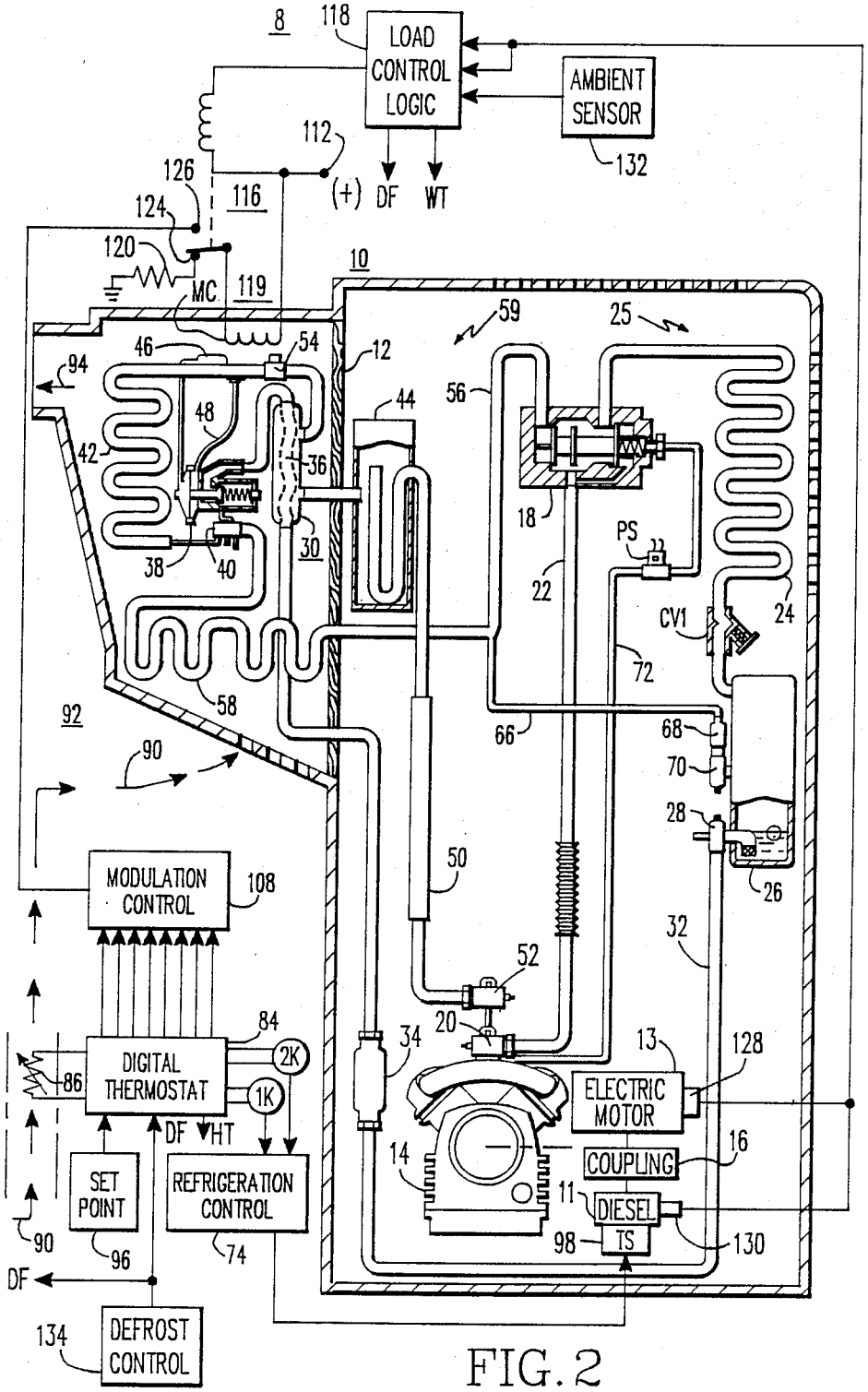
FIG. 2 is a detailed piping diagram of an exemplary refrigeration system which may be operated according to the teachings of the invention.

Referring now to the drawings, and to FIGS. 1 and 2 in particular, there is shown a system 8 constructed according to the teachings of the invention. System 8 includes a refrigeration system 10 having a suction line modulation valve, with system 10 being shown in detail in FIG. 2 having a suction line modulation valve 54. Both FIGS. and 2 will be referred to in the following description.

For purposes of example, refrigeration system 10 will be described as a transport refrigeration system, as the invention is well suited for use therein. Refrigeration system 10 is mounted on the front wall 12 of a truck, trailer, or container. Refrigeration system 10 includes a closed fluid refrigerant circuit which includes a refrigerant compressor 14 driven by a prime mover, such as an internal combustion engine Il, eg., a Diesel engine, and/or an electric motor 13, suitably coupled to compressor 14 via a coupling indicated generally at 16. Discharge ports of compressor 14 are connected to an inlet port of a three-way valve 18 via a discharge service valve 20 and a hot gas line 22. The functions of the three-way valve 18, which has heating and cooling positions, may be provided by separate valves, if desired.

One of the output ports of three-way valve 18 is connected to the inlet side of a condenser coil 24. This port is used as a cooling position of three-way valve 18, and it connects compressor 14 in a first refrigerant circuit 25. The outlet side of condenser coil 24 is connected to the inlet side of a receiver tank 26 via a one-way condenser check valve CV1 which enables fluid flow only from the outlet side of condenser coil 24 to the inlet side of receiver tank 26. An outlet valve 28 on the outlet side of receiver tank 26 is connected to a heat exchanger 30 via a liquid line 32 which includes a dehydrator 34.

Liquid refrigerant from liquid line 32 continues through a coil 36 in heat exchanger 30 to an expansion valve 38. The outlet of expansion valve 38 is connected to a distributor 40 which distributes refrigerant to inlets on the inlet side of an evaporator coil 42. The outlet side of evaporator coil 42 is connected to the inlet side of a closed accumulator tank 44 via the hereinbefore mentioned controllable suction line modulation valve 54 and heat exchanger 30. Expansion valve 38 is controlled by an expansion valve thermal bulb 46 and an equalizer line 48. Gaseous refrigerant in accumulator tank 44 is directed from the outlet side thereof to the suction port of compressor 14 via a suction line 50, and a suction line service valve 52. The modulation valve 54 is located in a portion of suction line 50 which is adjacent the outlet of evaporator 42 and prior to heat exchanger 30 and accumulator 44 in order to protect compressor 14 by utilizing the volumes of these devices to accommodate any liquid refrigerant surges which may occur while modulation valve 54 is being controlled.

In the heating and defrost position of three-way valve 18, a hot gas line 56 extends from a second outlet port of three-way valve 18 to the inlet side of evaporator coil 42 via a defrost pan heater 58 located below evaporator coil 42. A by-pass conduit or pressurizing tap 66, extends from hot gas line 56 to receiver tank 26 via by-pass and service check valves 68 and 70, respectively.

A conduit 72 connects three-way valve 18 to the intake side of compressor 14 via a normally closed pilot solenoid valve PS. When solenoid operated valve PS is closed, three-way valve 18 is spring biased to the cooling position, to direct hot, high pressure gas from compressor 14 to condenser coil 24. Condenser coil 24 removes heat from the gas and condenses the gas to a lower pressure liquid. When evaporator 42 requires defrosting, and also when a heating mode is required to hold the thermostat set point of the load being conditioned, pilot solenoid valve PS is opened via voltage provided by a refrigeration control function 74. Three-way valve 18 is then operated by the low compressor suction pressure to its heating position, in which flow of refrigerant in the form of hot gas to condenser 24 is sealed and flow to evaporator 42 is enabled. Suitable control 74 for operating solenoid valve PS is shown in the incorporated patents.

The heating position of three-way valve 18 diverts the hot high pressure discharge gas from compressor 14 from the first or cooling mode refrigerant circuit 25 into a second or heating mode refrigerant circuit 59 which includes distributor 40, defrost pan heater 58, and the evaporator coil 42. Expansion valve 38 is by-passed during the heating mode. If the heating mode is a defrost cycle, an evaporator fan or blower (not shown) is not operated. During a heating cycle required to hold a thermostat set point temperature, the evaporator blower is operated.

Refrigeration control 74 includes a thermostat 84 having a temperature sensor 86 disposed in a return air path 88, as illustrated, or in a discharge air path, as desired. The return air, indicated by arrows 90, is drawn from a served space 92. The return air 90 is then conditioned by passing it over evaporator 42, and it is then discharged back into the served space 92 by the evaporator blower, with the conditioned air being indicated by arrow 94. The thermostat 84 includes set point selector means 96 for selecting the desired set point temperature to which system 10 will control the temperature of the return air 90.

The thermostat 84 may be a digital thermostat, if desired, with digital thermostats which may be used being disclosed in U.S. Pat. No. 4,819,441 and in copending application Ser. No. 236,878 filed Aug. 26, 1988, entitled "Temperature Controller For A Transport Refrigeration System", now U.S. Pat. No. 4,903,498 with both being assigned to the same assignee as the present application. These patents are hereby incorporated into the specification of the present application by reference.

Signals provided by thermostat 84 control heat and speed relays 1K and 2K, respectively, which have contacts in refrigeration control 74, as illustrated in the incorporated patents. Heat relay 1K is de-energized when system 10 should be in a cooling mode, and it is energized when system 10 should be in a heating mode. Speed relay 2K is de-energized when system 10 should be operating prime mover 16 at low speed, eg., 1400 RPM, and it is energized when prime mover 16 should be operating at high speed, eg., 2200 RPM.

An exemplary control algorithm which may be used when the prime mover is engine 11 is shown in the diagram of FIG. 3. Operation with a falling temperature of the return air 90 is indicated along the left hand side of the diagram, starting at the top, and operation with a rising temperature of the return air 90 is indicated along the right hand side, starting at the bottom. Contacts of the heat relay 1K, for example, are connected in refrigeration control 74 to de-energize and energize the pilot solenoid valve PS, to select cooling and heating modes, respectively. Contacts of the speed relay 2K, for example, are connected in refrigeration control 74 to de-energize and energize a throttle solenoid 98 associated with engine 11, for selecting low and high speeds, respectively.

In the exemplary control algorithm of FIG. 3, upon initial temperature pull down the system 15 operates in high speed cool (HSC), not in range (NIR) until the temperature of the served space, or control error, as desired, reaches a predetermined value near set point, or zero control error, at which time the system switches to low speed cool, not in range (LSC-NIR). During this time the modulation valve is fully open. Close to set point, or zero control error, the system starts to close the modulation valve 54, with this mode being identified as "LSC-modulation" in the diagram. The system will then normally remain in low speed cool with modulation, with the temperature of the served space close to set point In low ambients, however, the temperature of the load space 92 may drop below set point, which initiates low speed heat (LSH) with modulation, with the modulation control opening valve 54 as the temperature continues to drop. A continued drop in temperature fully opens the modulation valve and initiates low speed heat, in range (LSH-IR), high speed heat, in range (HSH-IR) and high speed heat, not in range (HSH-NIR). A rising temperature from HSH-NIR successively initiates HSH with modulation, LSC with modulation, LSC-IR, LSC-NIR and HSC-NIR.

Modulation valve 54 has predetermined opening and closing characteristics, which are formed by charting valve opening or stroke in inches or millimeters versus control coil current. With no current flowing in a control coil MC of modulation valve 54, valve 54 is open. Increasing the coil current from zero follows the valve's closing characteristic, fully closing valve 54 at a predetermined current. Decreasing the coil current opens valve 54 according to the valve's opening characteristic curve.

Thermostat 84, if digital, as in the exemplary embodiment illustrated, provides an 8-bit digital signal having a magnitude responsive to the difference between the temperature sensed by temperature sensor 86, ie., the temperature of the return air 90, and the set point temperature selected by set point selector 96. This digital signal from thermostat 84 is translated to the desired valve control current by modulation control 108. Modulation control which may be used for function 108 is shown in the hereinbefore mentioned U.S. Pat. No. 4,899,549, and this patent is hereby incorporated into the specification of the present application by reference.

As shown in FIG. 1, modulation valve 54 includes a control coil MC connected to a source 112 of unidirectional potential. Source 112 may be provided by a true signal "Engine Run" or a true signal "Motor Run", which are output by refrigeration control 74 when refrigeration system 10 is to be made operative by a selected prime mover. A power supply 114 responsive to source 112 provides a control voltage VCC for operating logic circuits of the invention which will be hereinafter described.

A control relay 116 and a load control logic function 118 determine whether coil MC of modulation valve 54 is connected to modulation control 108 or to a circuit 119 having a resistor 120 connected to ground. Control relay 116 includes an electromagnetic coil 122, a normally closed contact 124, and a normally open contact 126, with circuit 119 being connected to the normally closed contact 124 and modulation control 108 being connected to the normally open contact 126.

The value of resistor 120 is selected to provide a predetermined partially closed position which would correspond to the restriction in the suction line 50 which would be provided by a prior art compressor throttling valve. The resistance value of resistor 120 is thus selected according to the type of refrigerant used in system 10 and the minimum horsepower which may be connected to drive the compressor during a heating or defrost cycle. The de-energized condition of control relay 116 thus connects the modulation coil MC to provide the same restriction as the conventional throttling valve, and this thus provides a fail safe configuration, should relay 116 fail.

The load control logic function 118 makes a decision as to whether or not to connect modulation coil MC to circuit 119, which overrides or cuts out modulation control 108, or to the modulation control 108, which isolates circuit 119. This decision is based upon inputs from temperature sensors 128, 130, and 132, a signal HT from thermostat 84 which is true when the refrigeration system 10 is in a heating mode to hold set point, and a signal DF from defrost control 134 which is true when a defrost heating mode is requested. Temperature sensor 128 detects the temperature of the electric motor 13. Temperature sensor 130 detects the temperature of the Diesel engine 11, such as the exhaust, oil, water or block temperature. Temperature sensor 132 monitors the temperature of the outside or ambient air.

Figure 4:
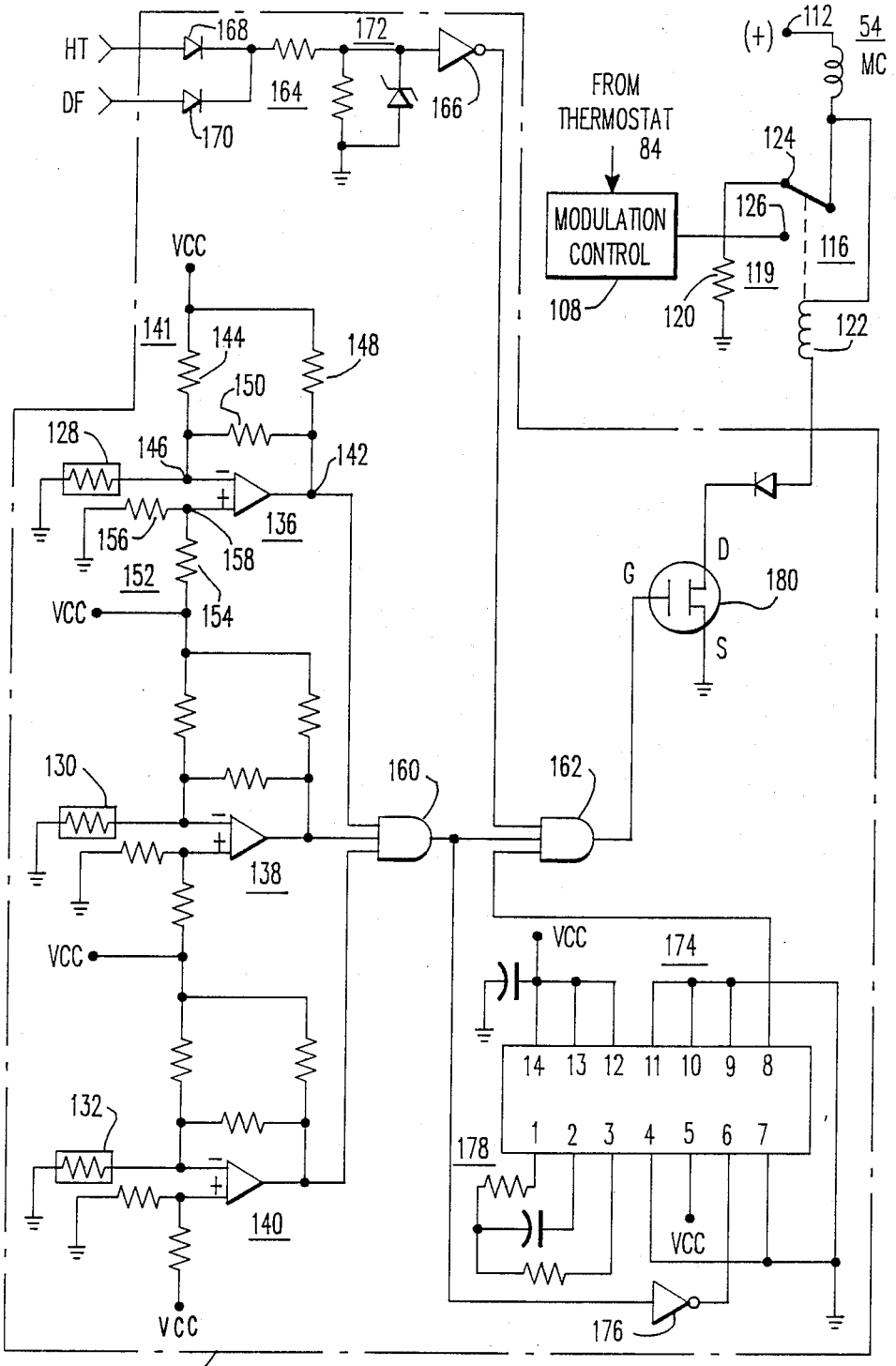
FIG. 4 is a detailed schematic diagram setting forth load control logic which may be used for this function shown in block form in FIGS. 1 and 3.

FIG. 4 is a detailed schematic diagram of a preferred embodiment of the load control logic function 11B. The outputs of sensors 128, 130 and 132 are compared with maximum allowable values for the motor, engine and ambient air temperatures in comparators 136, 138 and 140, respectively.

Since the comparators are similar in construction, only comparator 136 will be described. Comparator 136, such as National's LM239, has inverting (−) and non-inverting (+) inputs and an output 142. A sensor voltage divider 141 is provided by sensor 128 and a resistor 144, which are serially connected between VCC and ground, with the junction 146 being connected to the non-inverting input of comparator 136. A pull-up resistor 148 connects output 142 to VCC, and a feedback resistor 150 connects output 142 to the non-inverting input for hysteresis. A reference voltage divider 152 comprising resistors 154 and 156 connected serially from VCC to ground has a junction 158 between the resistors connected to the inverting input of comparator 136. As long as the temperature being sensed by sensor 128 is below the maximum allowable value set by the reference divider 152, the output of comparator 136 will be high. If the sensed temperature exceeds the reference temperature, the output of comparator 136 will switch low.

The outputs of comparators 136, 138 and 140 are connected to inputs of a three-input AND gate 160. The output of AND gate 160 provides an input to a three-input AND gate 162.

Another input to AND gate 162 is provided by a circuit 164 which is responsive to the heat and defrost signals HT and DF, respectively Signals HT and DF are coupled to the input of an inverter 166 via diodes 168 and 170 and by a voltage level shift circuit 172 which drops the level of signals HT and DF from battery level to logic level. If system 10 is not in a heating or defrosting mode, signals HT and DF will both be low and the output of inverter 166 will be high. Should either signal HT or DF be true (high), then inverter 166 will apply a logic zero to AND gate 162.

The remaining input to AND gate 162 is provided by a timer 174. Timer 174, which may be a LM4541BC, for example, has a reset input at pin #6 which is responsive to the output of AND gate 160 via an inverter 176. A low input to pin #6 allows timer 174 to run and accumulate count provided by an oscillator 178, and a high input to pin #6 resets the timer. Pin #8 of timer 174 is the output pin. Pin #8 is low when the timer is reset and while it is accumulating count, with pin #8 switching high when a predetermined count is accumulated, ie., when the timer "times out".

When all inputs to AND gate 162 are high, AND gate 162 provides a high output which turns on a solid state switch 180, such as an IAFD220, which is normally off and which is turned on by a positive gate to source voltage. Coil 122 of control relay 116 is connected to the drain D, and the source S is grounded.

In the operation of load control logic 118, it will first be assumed that system 8 has just been initialized and refrigeration system 10 is in a cooling mode, that the temperature of the operational prime mover is below the reference temperature, and that the outside or ambient air is below the reference temperature. This will provide all logic ones for the input of AND gate 160 and AND gate 160 will output a logic one. AND gate 162 will have two logic one inputs, and a logic zero input from timer 174. The high output from AND gate 160 will be inverted by inverter 176 and thus timer 174 will be started. Since control relay 116 will not be energized, modulation coil MC will be connected to circuit 119, causing modulation valve 54 to provide a restriction in suction line 50 equivalent to the restriction which would be provided by a conventional compressor throttling valve. Timer 174 thus assures that system 8 starts up in a partially unloaded condition, and that it remains in that condition until warmed up. A typical time-out value for timer 174 would be in the three to five minute range, for example. When timer 174 times out, AND gate 162 will have three high inputs and its output will switch high, turning on switch 180. Control relay 122, if functional, will then connect modulation coil MC to modulation control 108, enabling modulation to occur where indicated by the control algorithm of FIG. 3. If relay 116 should fail, system 10 will operate no worse than a prior art system with a compressor throttling valve.

Should any of the temperature sensors 128, 130 or 132 exceed their associated reference temperature, the output of the associated comparator will switch low, the output of AND gate 160 will go low, timer 174 will be reset and held in the reset mode to provide a low output at pin #8, the output of AND gate 162 will go low, solid state switch 180 will become non-conductive, and control relay 122 be de-energized. Modulation coil MC will thus be connected to circuit 119, to reduce the compressor pressure and cause the compressor load on the operative prime mover to drop. When the temperature which exceeded the reference value drops below the reference value, with hysteresis provided by the feedback resistor 150, AND gate 160 will output a logic one, which restarts timer 174. After timer 174 times out, control relay 116 will be re-energized, returning the control of modulation coil MC to modulation control 108.

If refrigeration system 10 goes into a heating mode, or if defrost control 134 requests a defrost cycle, which also results in the refrigeration system 10 going into a heating mode, inverter 166 will provide a logic one input to AND gate 162 for the duration of the heating or defrost cycle. During this time, control relay 116 will be de-energized, unloading the operative prime mover. As soon as the heating or defrost cycle terminates, control is immediately returned to the modulation control 108, as no recovery time is required for the operative prime mover, and no short cycle protection is required for control relay 116.

In summary, the present invention eliminates the need for a compressor throttling valve in refrigeration systems which have a suction line modulation valve 54, with a load control logic function 118 overriding and replacing the normal modulation control 108 when a need to unload the compressor 14 arises. The continuous restriction which would be provided by a prior art throttling valve is thus eliminated, enabling more capacity to be obtained during the cooling mode, and enabling the higher horsepower normally available from a Diesel engine 11 to be utilized when the system 10 is alternatively operable by an electric motor 13. The invention starts the refrigeration system 10 in a partially unloaded condition, and it maintains this partially unloaded condition for a period of time which enables the system to warm up properly before applying maximum load to the operative prime mover. If the outside ambient air should exceed a predetermined value selected according to the operating characteristics of the unit, the invention will automatically unload the compressor 14 to protect the operative prime mover during a cooling mode. When the refrigeration system switches to heat or defrost, compressor 14 is also automatically unloaded to protect the operative prime mover. If the temperature of the operative prime mover should exceed a predetermined safe operating value, compressor 14 is also automatically unloaded until the temperature drops back to a safe operating value plus a period of time set by timer 174 to allow full recovery by the operative prime mover. Timer 174 also prevents short cycling of the control relay 116 which switches the modulation coil MC between control by normal modulation control 108 and control by a pre-set circuit 119 which selects a predetermined restrictive position of the modulation valve 54. Timer 174 is also used to delay return to modulation control 108 following the return of ambient temperature below the predetermined maximum value.

What is claimed:

1. A method of controlling a refrigeration system having a compressor, with the compressor being driven by a prime mover, comprising the steps of:

providing a controllable modulation valve which is open in the absence of electrical current flow, disposing the modulation valve in the refrigeration system in a position which enables the modulation valve to control the amount of refrigerant flow to the compressor, controlling the modulation valve in a predetermined range near a selected set point temperature according to a predetermined control algorithm, with the control algorithm otherwise allowing the modulation valve to remain open, causing the modulation valve to provide a predetermined restriction in the flow of refrigerant to the compressor for a predetermined period of time following start-up of the compressor, overriding the control algorithm, providing an overload signal in response to a predetermined overload condition of the prime mover, and causing the modulation valve to provide said predetermined restriction in the flow of refrigerant to the compressor in response to the overload signal, overriding the control algorithm.

2. The method of claim 1, including the step of maintaining the predetermined restriction at least for the predetermined period of time, when the restriction is the result of the step of providing the overload signal.

3. The method of claim 1, including the steps of:

providing a temperature signal when the ambient temperature exceeds a predetermined value, and causing the modulation valve to provide the predetermined restriction in the flow of refrigerant to the compressor in response to the temperature signal, overriding the control algorithm.

4. The method of claim 3, including the step of maintaining the predetermined restriction at least for the predetermined period of time, when the restriction is the result of the step of providing the temperature signal.

5. The method of claim 1 wherein the refrigeration system controls the temperature of a served space by heating and cooling modes, and including the steps of:

providing a heat signal when the refrigeration system goes into a heating mode, and causing the modulation valve to provide the predetermined restriction in the flow of refrigerant to the compressor for the duration of the heat signal, overriding the control algorithm.

6. The method of claim 1 wherein the refrigeration system controls the temperature of a served space by heating and cooling modes, and wherein the refrigeration system includes defrost control which initiates a heating mode when defrost is required, and including the steps of:

providing a heat signal when the refrigeration system goes into a heating mode to hold the predetermined set point temperature, and when the refrigeration system goes into a heating mode in response to the defrost control, and causing the modulation valve to provide the predetermined restriction in the flow of refrigerant to the compressor for the duration of the heat signal, overriding the control algorithm.

7. In a refrigeration system for controlling the temperature of a served space via heating and cooling modes, wherein the refrigeration system includes a compressor driven by a prime mover, a refrigerant circuit which includes a condenser and an evaporator, a modulation valve in the refrigerant circuit positioned to restrict refrigerant returning to the compressor when operated from an open position towards a closed position, and modulation control for controlling the modulation valve according to a predetermined control algorithm which includes restricting the flow of refrigerant returning to the compressor in a predetermined range near a selected set point temperature and otherwise maintaining the modulation valve in an open position, the improvement comprising:

control means having first and second positions, with said first position connecting the modulation valve in a circuit which causes the modulation valve to provide a predetermined restriction in the flow of refrigerant returning to the compressor, and with said second position connecting the modulation valve to the modulation control, and sensor means for providing an overload signal in response to a predetermined overload condition of the prime mover, said control means being responsive to said overload signal, switching from said second position to said first position, if in said second position when said overload signal is provided.

8. In the refrigeration system of claim 7, including timer means for maintaining the control means in the first position for a predetermined period of time, following a switch to the first position in response to the overload signal.

9. In the refrigeration system of claim 7 including timer means for maintaining the control means in the first position for a predetermined period of time when the compressor is started.

10. In the refrigeration system of claim 7 including means providing a heat signal while the refrigeration system is in a heating mode, with said control means being responsive to said heat signal, switching from said second position to said first position, if in said second position when said heat signal is provided, for the duration of said heat signal, with said control means switching back to the second position at the termination of said heat signal in response to predetermined conditions.

11. In the refrigeration system of claim 7 including defrost means providing a defrost signal which forces the refrigeration system to a heating mode, with said control means being responsive to said defrost signal, switching from said second position to said first position, if in said second position when said defrost signal is provided, for the duration of said defrost signal, with said control means switching back to the second position at the termination of said defrost signal in response to predetermined conditions.

12. In the refrigeration system of claim 7 including ambient temperature sensor means for providing a temperature signal when the ambient temperature exceeds a predetermined value, with the control means being responsive to said temperature signal, switching from the second to the first positions, if in the second position when the temperature signal is provided, for the duration of said temperature signal, to restrict refrigerant flow to the compressor during a cooling mode.

13. In the refrigeration system of claim 7 wherein the control means is a control relay, with the first position being a de-energized position and the second position being an energized position, whereby the first position is a fail safe position which causes the modulation valve to provide the predetermined restriction in the flow of refrigerant returning to the compressor.

* * * * *